US005197046A

United States Patent [19]

Siu

[11] Patent Number: 5,197,046

[45] Date of Patent: Mar. 23, 1993

[54] WRIST WATCH AND WRIST WATCH STRAP COMBINATION

[75] Inventor: Leung-Cheung Siu, Tsuen Wan, Hong Kong

[73] Assignee: Siu Win Holding Co. Ltd., Tsuen Wan, Hong Kong

[21] Appl. No.: 839,306

[22] Filed: Feb. 20, 1992

[51] Int. Cl.[5] ..... G04R 37/00; A44C 5/00

[52] U.S. Cl. ..... 368/282; 224/174

[58] Field of Search ..... 368/281-282; 224/169, 174

[56] References Cited

U.S. PATENT DOCUMENTS

| | | | |
|---|---|---|---|
| 2,169,738 | 8/1939 | Moody | 368/282 |
| 2,612,302 | 9/1952 | Dinstman | 324/174 |
| 4,427,303 | 1/1984 | Matthias | 368/282 |

FOREIGN PATENT DOCUMENTS

| | | | |
|---|---|---|---|
| 1093310 | 5/1955 | France | 368/282 |
| 272325 | 3/1951 | Switzerland | 368/282 |
| 343944 | 2/1960 | Switzerland | 368/282 |

*Primary Examiner*—Vit W. Miska

*Attorney, Agent, or Firm*—Samuels, Gauthier & Stevens

[57] ABSTRACT

A wrist watch and wrist watch strap combination includes a pair of manually operable clasps for securing the ends of the strap to the watch. The owner can change the strap without using tools.

2 Claims, 3 Drawing Sheets

WRIST WATCH AND WRIST WATCH STRAP COMBINATION

FIELD OF THE INVENTION

The present invention relates to wrist watches and wrist watch straps.

Wrist watch straps are usually secured to wrist watches in a manner such that they cannot easily be detached. More particularly, they are attached in a manner which requires the use of a tool to remove the strap from the watch. Users often visit a jeweller or wrist watch shop for this purpose.

SUMMARY OF THE INVENTION

An object of the present invention is to reduce the difficulty in changing a watch strap, so that a wrist watch owner can change the strap without any need for tools or visits to jewellers.

The invention provides a wrist watch and wrist watch strap combination including a pair of manually operable securing means for securing the ends of the watch strap to the watch.

In a particularly preferred construction, the wrist watch includes extensions at the 6 o'clock and at the 12 o'clock positions, and hinged flaps mounted at the end of the extensions which may be closed over the extensions into snap fitting engagement with the extensions, and the wrist watch strap ends each include an eye for receiving the hinged flaps so that when the hinged flaps are passed through the eyes and closed down over the projections the ends of the wrist watch strap are secured in position, but are readily releasable by manually disengaging the hinged flaps.

BRIEF DESCRIPTION OF THE DRAWINGS

The invention will now be described more particularly with the reference to the accompanying drawings which show, by way of example only, one construction of wrist watch and wrist watch strap combination in accordance with the invention, and two variants thereof. In the drawings.

DETAILED DESCRIPTION OF PREFERRED EMBODIMENTS

Figure 1B:
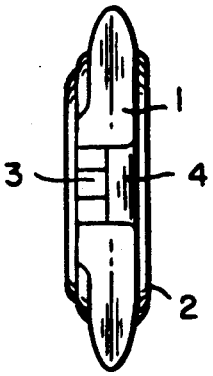
FIGS. 1*a*, 1*b* and 1*c* show top, end-on and side views respectively of the wrist watch without the wrist watch strap and with the securing-release mechanism in the closed or secured configuration.
Figure 1A:
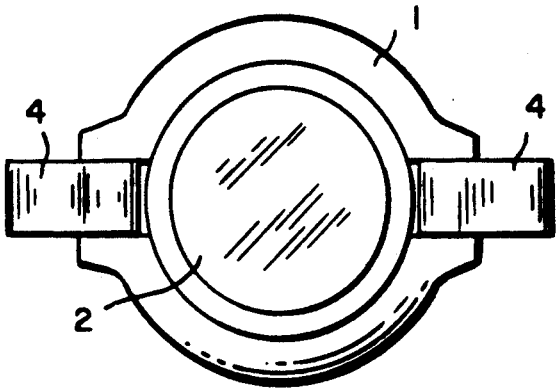
Figure 1C:
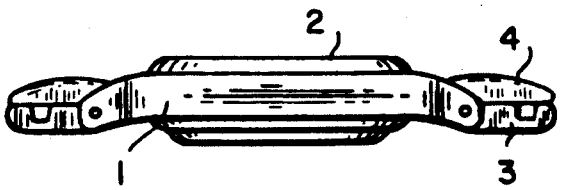
Figure 2A:
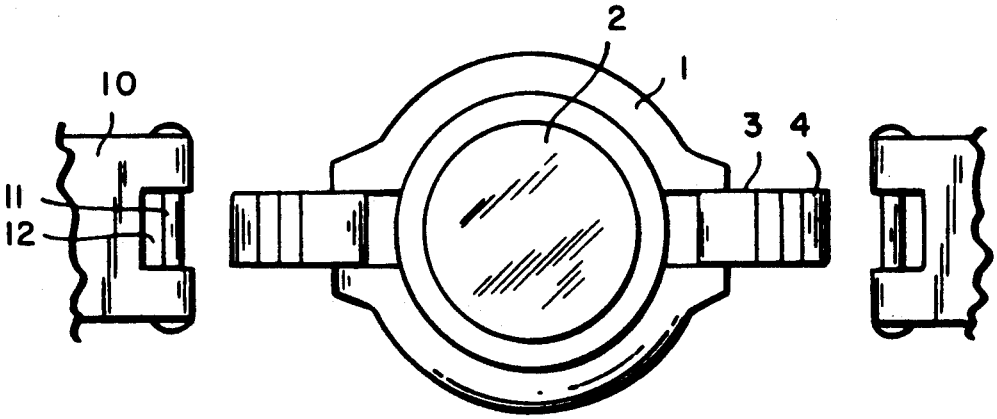
FIGS. 2*a* and 2*b* show top and side views respectively of the wrist watch with the securing-release mechanism in the open or released configuration ready to receive the ends of a wrist watch strap, and showing partial views of the wrist watch strap.
Figure 2B:
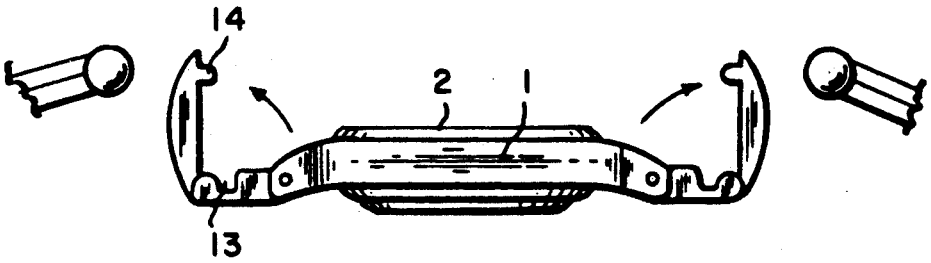
Figure 3A:
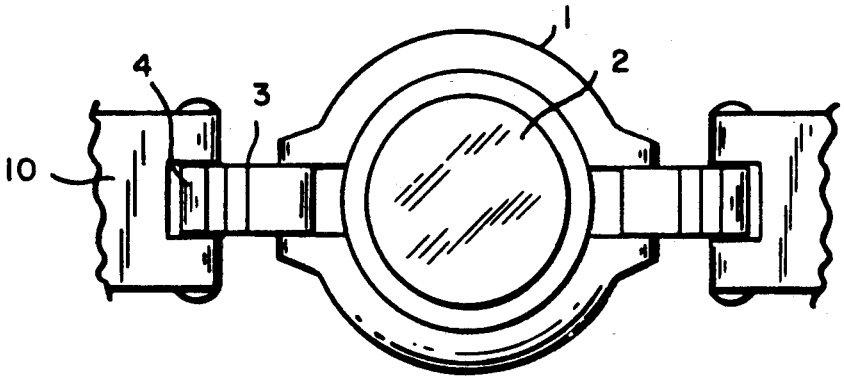
FIGS. 3*a* and 3*b* are similar to FIGS. 2*a* and 2*b*, but show the wrist watch strap after connection to the wrist watch, but with the securing-release mechanism still in the released configuration.
Figure 3B:
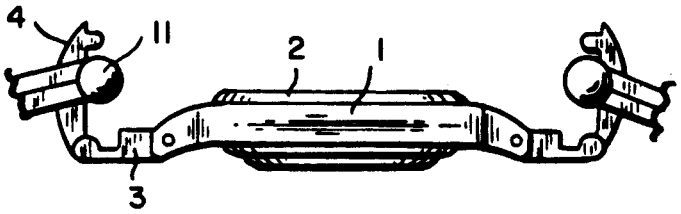

Referring to FIGS. 1 to 5, the wrist watch comprises a housing 1, a face 2, hinged projections 3 extending from the 6 o'clock and the 12 o'clock positions, hinged flaps 4 moveable between an open or released position as shown in FIGS. 2*a*, 2*b*, 3*a*, 3*b* and a closed or securing configuration as shown in FIGS. 1*a*, 1*b*, 1*c*, 4*a*, 4*b*, 5. The strap 10 comprises yoke-shaped ends traversed by transverse bars 11 defining receiving eyes or apertures 12.

Figure 4A:
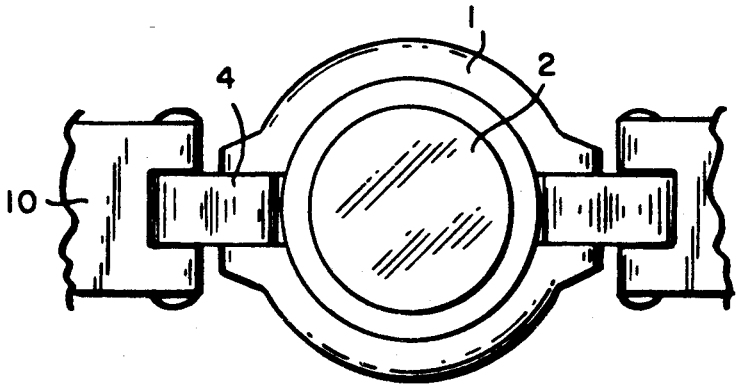
FIGS. 4*a* and 4*b* are similar to FIGS. 3*a* and 3*b*, but show the securing-release mechanism in the secured or closed configuration.
Figure 4B:
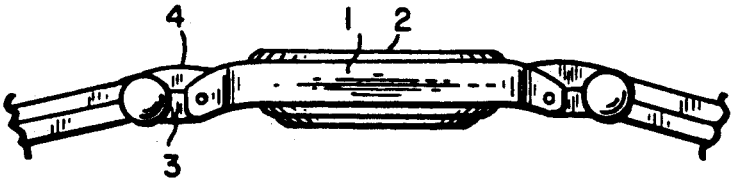
Figure 5:
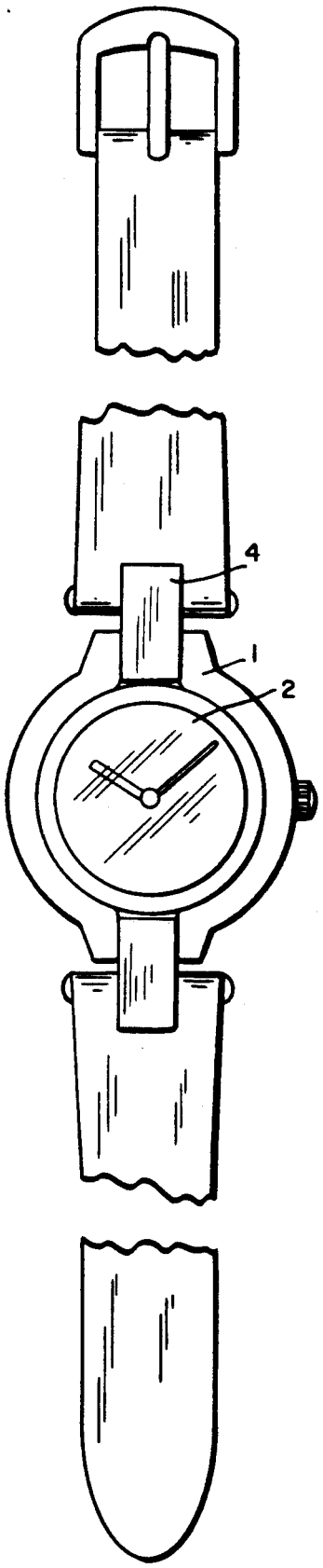
FIG. 5 is a top view of the wrist watch and wrist watch strap combination.
Figure 6:
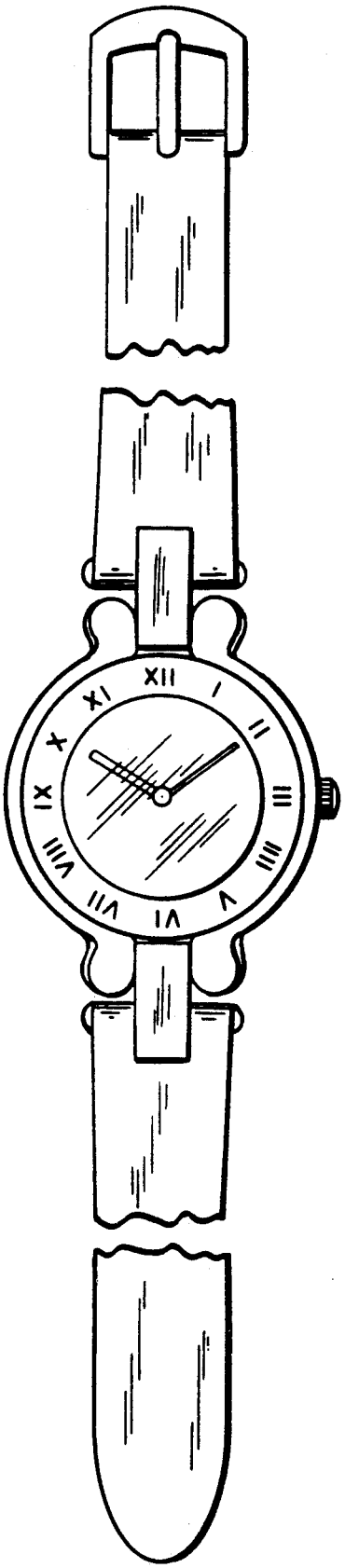
FIG. 6 shows an alternative wrist watch and wrist watch strap combination.
Figure 7:
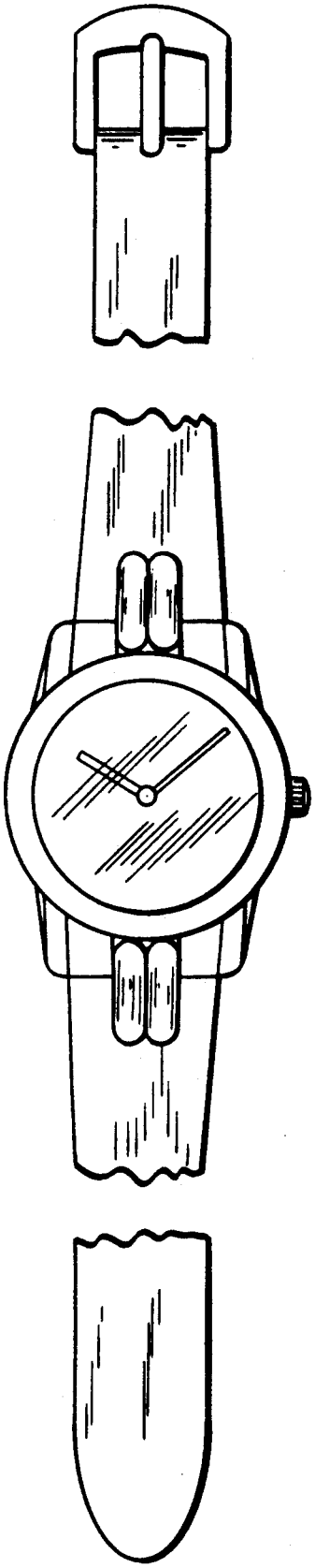
FIG. 7 shows a still further wrist watch and wrist watch strap combination.

In use, when it is desired to attach a wrist watch strap 10 to a wrist watch, the flaps 4 are moved from the closed position (see FIGS. 1*a*1*b*, 1*c*) to the open position and the two ends of the strap 10 are brought into proximity with the flaps 4 (FIGS. 2*a*, 2*b*) and are then fitted over the flaps 4 so that the flaps 4 extend up through the eyes 12 (FIGS. 3*a*, 3*b*) and finally the flaps are closed over (FIGS. 4*a*, 4*b*). In the closed position the transverse bars 11 extend through corresponding apertures 13 in the side wall of the flaps 4, and the flaps 4 are retained in the closed position by the push fit engagement of the front lip 14 against the end of the watch housing 1.

The advantage of the combination according to the invention is that the wrist watch owner can easily remove the strap and replace it by another strap. Such removal and replacement may occur when a strap reaches the end of its useful life. Alternatively, such removal and replacement may occur on a regular basis in the case of a fashion conscious wrist watch owner, with the owner possessing one or more wrist watches, and a number of straps, and interchanging them in various combinations.

I claim:

1. A wrist watch and wrist watch strap combination including a pair of manually operable securing means for securing the ends of the watch strap to the watch, wherein the wrist watch includes hinged extension flaps at the 6 o'clock and the 12 o'clock positions, and hinged closure flaps mounted at the end of each extension flap which may be closed over the extension flap into snap fitting engagement with the extension flap, and the wrist watch ends each include an eye for receiving a hinged flap so that when the hinged closure flaps are passed through the eyes and closed down over the hinged extension flaps into snap fitting engagement, the ends of the wrist watch strap are secured in position, but are readily releasable by manually disengaging the hinged closure flaps.

2. A wrist watch assembly, comprising:

a wrist watch, a strap having apertured ends;

securing means for securing of said apertured ends to said watch case, each said securing means having at least one closure flap and at least one extension flap, said extension flap being pivotally coupled to said watch case and said closure flap being pivotally coupled to said extension flap, said closure flap being adapted to pass through a respective one of said aperture ends and to be pivoted into snapped engagement with the associated extension flap to capture said apertured end therebetween.

* * * * *